US005320012A

United States Patent [19]

Abe

[11] Patent Number: 5,320,012

[45] Date of Patent: Jun. 14, 1994

[54] METHOD OF TRIMMING MOLDED CEILING FOR AUTOMOTIVE VEHICLE OR THE LIKE

[75] Inventor: Nobuo Abe, Kanagawa, Japan

[73] Assignee: Ikeda Bussan Co., Ltd., Ayase, Japan

[21] Appl. No.: 977,641

[22] Filed: Nov. 17, 1992

[30] Foreign Application Priority Data

Nov. 25, 1991 [JP] Japan ..... 3-335717

[51] Int. Cl.[5] ..... B26D 1/09; B26D 7/08

[52] U.S. Cl. ..... 83/19; 83/622; 83/697; 83/914; 83/953

[58] Field of Search ..... 83/18, 54, 175, 620, 83/622, 697, 929, 953, 176, 914, 19; 30/304, 305

[56] References Cited

U.S. PATENT DOCUMENTS

| | | | |
|---|---|---|---|
| 3,077,215 | 2/1963 | Kentor | 83/697 X |
| 3,255,649 | 6/1966 | Buttery | 83/622 X |
| 3,259,003 | 7/1966 | Griffin | 83/54 |
| 3,786,708 | 1/1974 | Mumper | 83/622 X |
| 4,104,942 | 8/1978 | Leloux | 83/54 X |
| 4,785,695 | 11/1988 | Riley | 83/49 |
| 5,168,787 | 12/1992 | Blaimschein | 83/914 X |

FOREIGN PATENT DOCUMENTS 0497078 8/1992 European Pat. Off. .

*Primary Examiner*—Eugenia Jones
*Attorney, Agent, or Firm*—Foley & Lardner

[57] ABSTRACT

As a cutter having first and second cutter blades is driven toward a molded ceiling consisting of a base material and a surface material which is attached to the base material in a stretched state, the surface material is first cut by the first cutter blade which is adapted to cut the molded ceiling at a position outside of a predetermined trimming or cutting position such that the trimmed or cut end of the surface material is inclined to have a flat triangular sectional shape. Then, the inclined end of the surface material is cut off together with an excess portion of the base material by means of the second cutter blade which is adapted to cut the molded ceiling at the predetermined trimming or cutting position.

8 Claims, 3 Drawing Sheets

METHOD OF TRIMMING MOLDED CEILING FOR AUTOMOTIVE VEHICLE OR THE LIKE

BACKGROUND OF THE INVENTION

1. Field of the Invention

The present invention relates in general to a method of and apparatus for trimming a padded board such as a molded ceiling for an automotive vehicle and more particularly to a method of and apparatus for trimming, using a cutter, an automotive molded ceiling consisting of a base material and a surface material attached to the surface material in a stretched state.

2. Description of the Prior Art

A molded ceiling for an automotive vehicle or the like is well known in the art and exemplarily shown in FIGS. 4, 5A and 5B. The molded ceiling 1 consists of a base material 2 made of paperboard such as corrugated board and a surface material 3 attached in a stretched state to the base material. The surface material 3 consists of an outer covering 4 and a cushion 5.

Such a molded ceiling 1 is formed into a desired shape and size by trimming, i.e., by cutting down using a cutter as shown in FIG. 5A or by bending the surface material upon the rear surface of the base material to be bonded thereto as shown in FIG. 4.

The molded ceiling shown in FIG. 5A is more desirable from the cost point of view as compared with that shown in FIG. 4. However, this type of molded ceiling has a disadvantage in that it has a likelihood of being deteriorated in appearance due to the fact that the surface material 3 is attached in a stretched state to the base material 2 and its trimmed end is pulled inward after cutting to expose the cushion 5 and the base material 2 to view as shown in FIG. 5B. Such a disadvantage may cause the necessity of enlarging a black-colored print portion 9 on a windshield glass 8 or the like for hiding its end portion from view, thus causing another disadvantage of a narrowed driver's sight.

SUMMARY OF THE INVENTION

According to an aspect of the present invention, there is provided a method of trimming a padded board consisting of a hard board and a soft pad attached in a stretched state to one side of the hard board, which comprises the steps of using a cutter having first and second cutter blades, the first cutter blade being protruded more toward the padded board and disposed more outward of the padded board than the second cutter blade, driving the cutter toward the padded board and thereby cutting the soft pad at a position outside of a predetermined trimming position by the first cutter blade, and driving the cutter further toward the padded board and thereby cutting the hard board at the predetermined trimming position by the second cutter blade.

In accordance with another aspect of the present invention, there is provided a method of trimming a molded ceiling consisting of a base material and a surface material attached in a stretched state to the base material, which comprises the steps of using a cutter having first and second cutter blades, the first cutter blade being protruded more toward the molded ceiling and disposed outside of the second cutter blade, cutting at least the surface material of the molded ceiling at a position outside of a predetermined cutting position by means of the first cutter blade, and cutting at least the base material of the molded ceiling at the predetermined cutting position by means of the second cutter blade.

In accordance with a further aspect of the present invention, there is provided a method of trimming a molded ceiling consisting of a base material made of paperboard and an elastic surface material attached in a stretched state to the base material, the surface material consisting of an outer covering and cushion, which comprises using a cutter having first and second cutter blades disposed on one side of the molded ceiling and fixedly installed on a holder, the first cutter blade being protruded more toward the molded ceiling and disposed more outward of the molded ceiling than the second cutter blade, and driving the cutter toward the molded ceiling and thereby first cutting the surface material of the molded ceiling at a position outside of a predetermined trimming position by means of the first cutter blade and then cutting at least the base material of the molded ceiling at the predetermined trimming position by means of the second cutter blade.

In accordance with a further aspect of the present invention, there is provided an apparatus for trimming a padded board consisting of a hard base and a soft pad attached to one side of the base, which comprises a jig for supporting the padded board in place, and a cutter movable toward and away from the jig and having first and second cutter blades, the first cutter blade being protruded more toward said jig than the second cutter blade, the first cutter blade being disposed so as to cut at least the pad of the padded board at a position outside of a predetermined trimming position, the second cutter blade being disposed so as to cut at least the base of the padded board at the predetermined trimming position after cutting of at least the pad by the first cutter blade.

In accordance with a further aspect of the present invention, there is provided an apparatus for trimming a molded ceiling consisting of a base material and a surface material attached in a stretched state to the base material, which comprises a jig for supporting the molded ceiling in place, and a cutter movable toward and away from the jig and having first and second cutter blades, the first cutter blade being protruded more toward the jig than the second cutter blade, the first cutter blade being disposed so as to cut at least the surface material of the molded ceiling at a position outside of a predetermined trimming position, the second cutter blade being disposed so as to cut at least the base material of the molded ceiling at the predetermined trimming position after cutting of at least the surface material by the first cutter blade.

The above method and structure are effective for solving the above noted problems inherent in the prior art device.

It is accordingly an object of the present invention to provide a method of trimming a padded board such as a molded ceiling for an automotive vehicle or the like which makes it possible to obtain a padded board or a molded ceiling of an improved appearance with ease and assuredness.

It is a further object of the present invention to provide an apparatus for trimming a padded board such as a molded ceiling for an automotive vehicle or the like, which makes it possible to obtain a padded board or a molded ceiling of an improved appearance with ease and assuredness.

DETAILED DESCRIPTION OF THE PREFERRED EMBODIMENT

Figure 1:
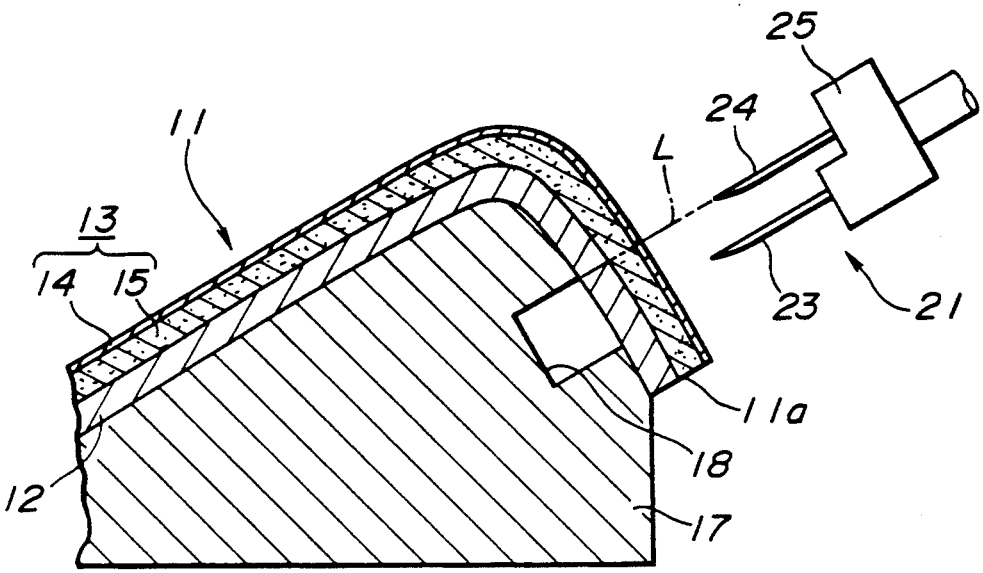
FIG. 1 is a fragmentary sectional view of an apparatus for trimming a molded ceiling according to an embodiment of the present invention.
Figure 2:
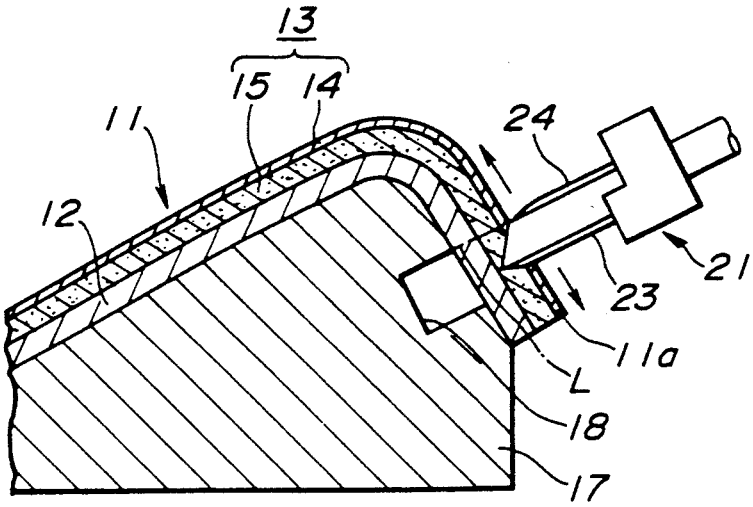
FIG. 2 is a view similar to FIG. 1 but shows an operating condition in which the molded ceiling is being cut down.
Figure 3:
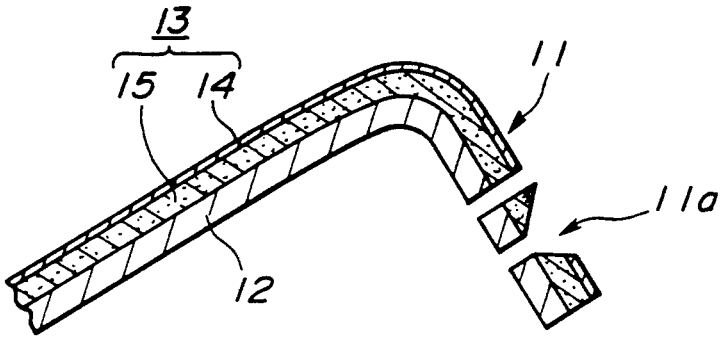
FIG. 3 is a fragmentary sectional view of a molded ceiling having been trimmed by the apparatus of FIG. 1 together with portions cut off.
Figure 4:
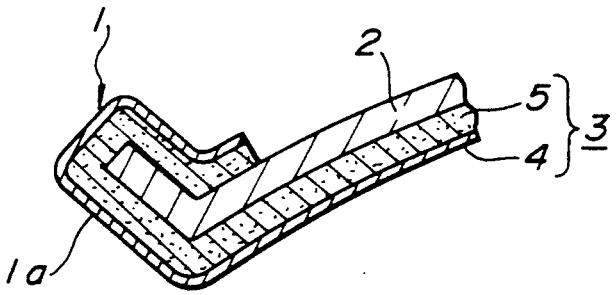
FIG. 4 (PRIOR ART)
FIG. 4 is a fragmentary sectional view of a prior art molded ceiling having a bent end portion.
Figure 5A:
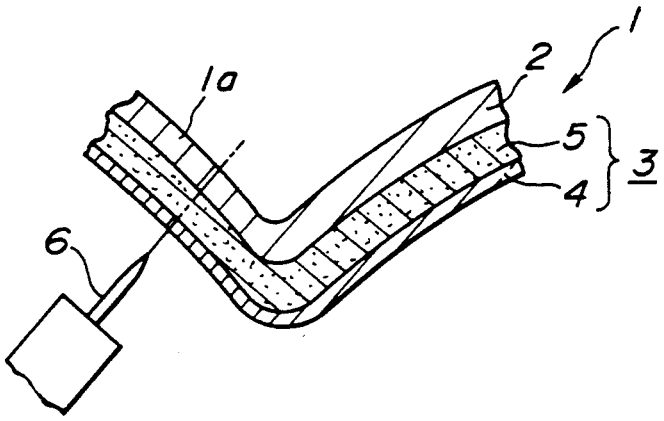
FIG. 5A (PRIOR ART)
FIG. 5A is a fragmentary sectional view for illustrating a prior art method of trimming a molded ceiling.
Figure 5B:
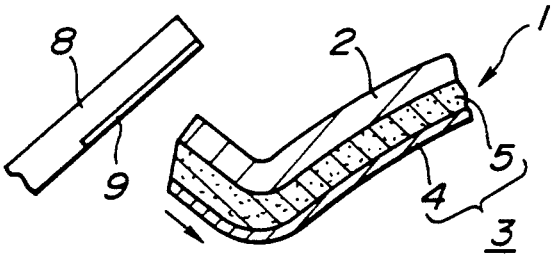
FIG. 5B (PRIOR ART)
FIG. 5B is a fragmentary sectional view of a molded ceiling having been trimmed according to the prior art method of FIG. 5A.

Referring to FIGS. 1 through 3, an apparatus for trimming a molded ceiling 11 according to an embodiment of the present invention consists of a jig 17 and a cutter 21.

The molded ceiling 11 is formed from a base material 12 made of paperboard such as corrugated board and a soft, elastic surface material 13 bonded or otherwise secured in a stretched state to the surface of the base material 12. The surface material 13 is formed from an outer covering 14 and a cushion 15 made of urethane or the like.

The jig 17 has a recess 18 for receiving therein the cutter 21, i.e., for allowing the leading end of the cutter 21 to penetrate through the molded ceiling 11 into the jig 17 at the time of trimming of the molded ceiling 11. When the jig 17 fittingly supports thereon the molded ceiling 11, a predetermined trimming or cutting position L of the molded ceiling 11 is located in place, i.e., located above the recess 18.

The cutter 21 consists of a first cutter blade 23, a second cutter blade 24 in parallel to the first cutter blade 23 and a holder 25 fixedly holding thereon the first and second cutter blades 23 and 24. As shown in FIGS. 1 and 2, the first cutter blade 23 protrudes from the holder 25 more than the second cutter blade 24, i.e., the first cutter blade 23 protrudes toward the jig 17 or the molded ceiling 11 more than the second cutter blade 24 so that the first cutter blade 23 starts cutting the molded ceiling 11 earlier than the second cutter blade 24 at the time of trimming of the molded ceiling 11. Further, the first cutter blade 23 is disposed outside of the second cutter blade 24, i.e., the first cutter blade 23 is located more outward of the molded ceiling 11 as compared with the second cutter blade 24 so that the molded ceiling 11 is trimmed or cut at a position outside of a predetermined cutting position L by the first cutter blade 23.

With such a jig 17 and a cutter 21, the molded ceiling 11 is trimmed or cut as follows. When the cutter 21 is driven toward the molded ceiling 11, the molded ceiling 11 is first cut at a position outside of the predetermined trimming or cutting position L by the first cutter blade 23. In this instance, the outer covering 14 is pulled in opposite directions away from the first cutter blade 23 as indicated by the arrows in FIG. 2, thus allowing the end surface of the molded ceiling 11 to decline outward, i.e., allowing the sectional shape of the end of the molded ceiling to be formed into a flat triangular shape.

The molded ceiling 11 is then cut at the predetermined trimming or cutting position L by the second cutter blade 24. In this instance, since the end of the outer covering 14 has been pulled into a position adjacent to the predetermined trimming or cutting position L, it is not pulled to move inward again at the time of cutting by the second cutter blade 24. In this connection, it is necessary to set the distance between the first and second cutter blades 23, 24 suitably on consideration of the pulled or moved distance (usually around 3 mm~4 mm) of the end of the outer covering 14 at the time of cutting by the first cutter blade 23.

Further, in order that the molded ceiling 11 can be cut by the second cutter blade 24 under the condition that the end portion of the external covering 14 is pulled sufficiently inward and freed of tension, the first cutter blade 23 is set so as to protrude at least a distance corresponding to the thickness (around 4 mm~5 mm) of the surface material 13 more than the second cutter blade 24.

As shown in FIG. 3, the molded ceiling 11 trimmed in the above manner does not cause the end of the external covering 14 to be pulled inward after the cutting by the second cutter blade 24 and therefore there is no probability or likelihood that the cushion 15 and the base material 12 are exposed to view to deteriorate the appearance.

From the foregoing, it will be understood that according to the present invention the surface material of the molded ceiling is first cut at a position outside of a predetermined trimming or cutting position by means of a first cutter blade protruding more than a second cutter and located outside of same, and then the base material of the molded ceiling is cut at the predetermined trimming or cutting position by means of the second cutter blade, thus making it possible to cut the tensioned outer covering by the first cutter blade and then cut the base material, etc. of the molded ceiling under the condition of being freed of tension by means of the second cutter blade and therefore making it possible to obtain a molded ceiling which is neatly cut or trimmed and which is free from a disadvantage that in use its base material, etc. is exposed to view to deteriorate the appearance.

In the foregoing, while the two cutter blades have been described and shown as above, various modifications and variations may be made thereto. For example, the first cutter blade may be arranged obliquely toward the predetermined trimming or cutting position so that the first cutter blade cuts only the surface material obliquely and then the second cutter blade cuts only the exposed base material or the first cutter blade may be stopped or moved backward after it finishes cutting the surface material.

Further, the first cutter blade may be movably installed on the holder so as to protrude into a predetermined position only in use, by using a cylinder, etc. Further, the first cutter blade may be stationarily installed while the second cutter blade 24 may be made movably installed on the holder so as to move into a predetermined position only in use, by using a cylinder, etc. Further, the first and second cutter blades may be movably installed on the holder in such a manner as to be movable toward and away from each other so that they are moved into predetermined positions only in use.

What is claimed is:

1. A method of trimming a padded board consisting of a hard board and a soft elastic pad attached in a stretched state to one side of the hard board, comprising the steps of:

using a cutter having first and second cutter blades, said first cutter blade being protruded more toward the padded board and disposed more outward of the padded board than said second cutter blade;

driving said cutter toward said padded board and thereby cutting the elastic pad at a position adjacently outside of a predetermined trimming position by said first cutter blade for thereby providing the elastic pad with an end portion which is substantially freed of tension and which is located adjacently outside of said predetermined trimming position; and driving said cutter further toward said padded board and thereby cutting the hard board at said predetermined trimming position while cutting off the end portion of the elastic pad by said second cutter blade.

2. A method of trimming a molded ceiling consisting of a base material and an elastic surface material attached in a stretched state to the base material, comprising the steps of:

using a cutter having first and second cutter blades, said first cutter blade being protruded more toward the molded ceiling and disposed outside of said second cutter blade;

cutting the surface material of the molded ceiling at a position adjacently outside of a predetermined cutting position by means of said first cutter blade for thereby providing the surface material with an end portion which is freed of tension and has a triangular cross sectional shape; and cutting the base material of the molded ceiling at said predetermined cutting position while cutting off the end portion of the surface material by means of said second cutter blade.

3. A method according to claim 2, further comprising, before the step of cutting the surface material, the step of driving said cutter toward the molded ceiling.

4. A method according to claim 3, further comprising, before the step of cutting, the step of estimating the triangular cross-sectional shape of the surface material and setting the distance between said first and second cutter blades depending upon the estimated triangular cross sectional shape.

5. A method according to claim 3, further comprising, before the step of cutting, the step of setting the difference in protrusion between said first and second cutter blades depending upon the thickness of the surface material.

6. A method of trimming a molded ceiling consisting of a base material made of paperboard and an elastic surface material attached in a stretched state to the base material, the surface material consisting of an outer covering and a cushion, comprising:

using a cutter having first and second cutter blades disposed on one side of the molded ceiling and fixedly installed on a holder, said first cutter blade being protruded more toward the molded ceiling and disposed more outward of the molded ceiling than said second cutter blade; and driving said cutter toward the molded ceiling and thereby first cutting the surface material of the molded ceiling at a position adjacently outside of a predetermined trimming position by means of said first cutter blade for allowing an end of the outer covering to be pulled into a position adjacent to said predetermined trimming position and thereby providing the surface material with an inclined end portion which is substantially freed of tension and then cutting the base material of the molded ceiling at said predetermined trimming position while cutting off the inclined end portion of the surface material by means of said second cutter blade.

7. A method according to claim 6, further comprising, before the step of driving said cutter toward the molded ceiling, the step of estimating movement of the end of the outer covering when the outer covering is cut by said first cutter blade and setting the distance between said first and second cutter blades depending upon the estimated movement of the end of the outer covering.

8. A method according to claim 6, wherein the step of using comprises the step of setting the difference in protrusion between said first and second cutter blades to be equal to or larger than the thickness of the surface material.

* * * * *